US005455987A

United States Patent [19]

Svehaug

[11] Patent Number: 5,455,987

[45] Date of Patent: Oct. 10, 1995

[54] ONE-PIECE HINGE

[76] Inventor: Oswald C. Svehaug, 124 N. Glover St., Chula Vista, Calif. 91910

[21] Appl. No.: 222,249

[22] Filed: Apr. 4, 1994

[51] Int. Cl.[6] ..... E05D 7/10

[52] U.S. Cl. ..... 16/267; 16/385

[58] Field of Search ..... 16/267, 254, 260, 16/261, 265, 266, 385, 386, 387, 273, 274, 234, 235, DIG. 13, 309, 312, 316

[56] References Cited

U.S. PATENT DOCUMENTS

| | | | |
|---|---|---|---|
| 32,482 | 6/1861 | Lane | 16/265 |
| 110,020 | 12/1870 | Drahota | 16/316 |
| 2,555,473 | 6/1951 | Deaton | 16/266 |
| 3,000,049 | 9/1961 | Terry, Jr. | 16/386 |
| 3,295,713 | 1/1967 | Optner | 16/265 |
| 3,703,742 | 11/1972 | Konishi | 16/385 |
| 3,911,528 | 10/1975 | Rojic, Sr. | 16/386 |
| 3,921,225 | 11/1975 | Suska | 16/273 |
| 4,383,478 | 5/1983 | Jones | 16/273 |
| 4,603,452 | 8/1986 | Paciorek | 16/386 |
| 5,008,551 | 4/1991 | Randolph | 16/121 |
| 5,127,132 | 7/1992 | Katlin | 16/265 |

*Primary Examiner*—P. Austin Bradley
*Assistant Examiner*—Chuck Y. Mah
*Attorney, Agent, or Firm*—Ralph S. Branscomb

[57] ABSTRACT

A simple hinge is defined from a single-part component which is used in pairs as hinge halves which mutually engage to define a tough, long-lasting hinge. The hinge pin, and hinge sleeve which engages the pin, are in effect separated into component lengths defined on alternate sides of the hinge line on the respective hinged halves so that each hinge half defines a portion of the entire pin and a portion of the sleeve. These sleeve/pin lengths engage the pin/sleeve lengths of the identical, but reversed, mating half. In one important form, the hinge sleeves are helically cut to interstitially engage ribs defined on the pin segments so that the sleeve halves axially migrate as they rotate about the hinge axis, forming a self-closing hinge.

13 Claims, 3 Drawing Sheets

Fig. 22
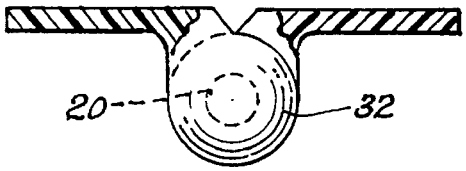
Fig. 23
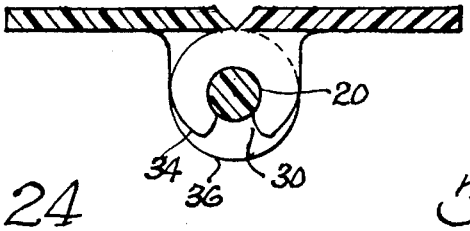
Fig. 24
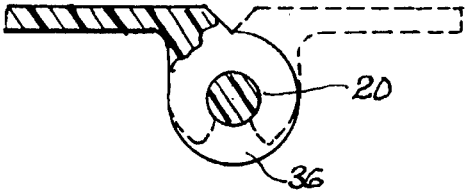
Fig. 25
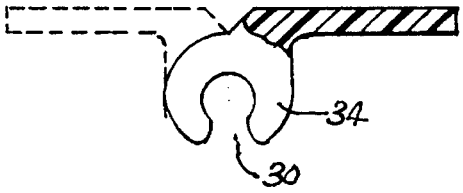
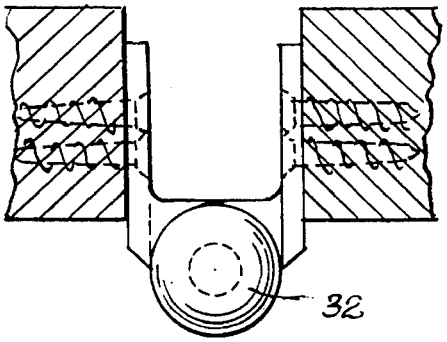
Fig. 26
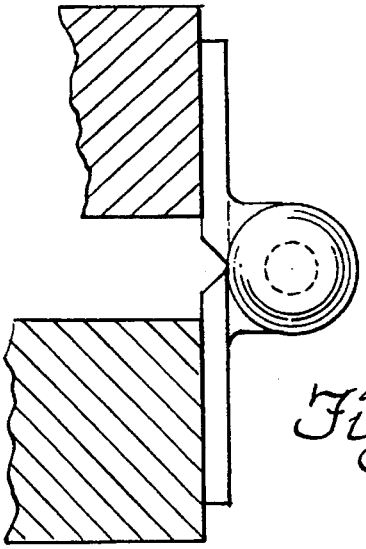
Fig. 27
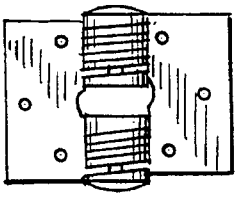
Fig. 28

ONE-PIECE HINGE

BACKGROUND OF THE INVENTION

Hinges are subject to weathering, daily wear and abuse over the years, leading to eventual failure. Outdoors they rust and are subject to being removed for unauthorized entry by the simple expediency of pulling the pins. When the pins are removed or stolen, they are often replaced by nails or other stop-gap means, resulting in their less than optimal performance.

Most outdoor hinges do not have a self-closing feature, and most that do close with a weighted rope on a pulley or with a spring. The vast majority of gates and even more doors have lo no self-closing feature at all despite the many cases in which clearly either the open or the closed position should be established as the default mode, especially when infants and small children are about.

Hinges have been designed which are self-closing, and there are also hinges assembled from two identical halves. Most require a separate hinge pin and some have structure which avoids the use of a pin. However, often these are not designed for outdoor use, and no known one-piece hinge is automatically self-closing Some are made of plastic or nylon rather than metal, and thus avoid the corrosive effects of weather over time. By and large however, they require the use of additional structure to make a complete unit, such as a hinge pin or a clip to hold the halves together. Or, alternatively there is a one-piece hinge of the "living hinge" variety, having a limited life as at the bend line of the material is repeatedly worked back and forth until it parts.

There is a need for a weatherproof, durable, simply and rugged hinge made from two identical parts that require the use of no additional structure, the two parts of which axially migrate with respect to one another when mutually rotated such that a swing-closed feature is inherent in the design without additional components.

SUMMARY OF THE INVENTION

The instant invention fulfills the above-stated need by providing a hinge that is assembled from two identical parts molded in nylon or other tough plastic. The two pieces together define the hinge pin and the sleeves that engage the hinge pin, all as integrally molded parts, with each piece providing half of the pin. The pins and sleeves alternate from one half to the other so that they matingly interengage. Joinder of the two hinge halves is made possible by the reduced thickness dimension of the hinge pins in one direction, due to a flat defined in the side of the cylindrical pin, and a slot in the sleeve which permits the passage therethrough of the hinge pin when the flat is properly oriented. After the hinge is swung into operative position, the pin can no longer escape through the slot in the sleeve.

In an important version of the invention the pin sleeve structure is helically cut (or molded) to build in a swing-shut feature, and in any of the embodiments the hinge material could be o phosphorescent to provide night-time delineation of the door or gate frame, and impregnated with a permanently bleeding lubricant.

BRIEF DESCRIPTION OF THE DRAWINGS

FIRST EMBODIMENT.

FIG. 1 is an end elevation view of the first embodiment of the hinge showing it in its engaged, 180° extended mode;

FIG. 2 illustrates the two hinged halves of FIG. 1 separated;

FIG. 3 is the front elevation view showing the hinge halves engaged;

FIG. 4 is identical to FIG. 3 but showing the hinged halves separated;

FIG. 5 is an elevation view of the rear of the hinge configuration shown in FIG. 3;

FIG. 6 is a rear elevation view of the separated configuration shown in FIG. 4;

FIG. 7 is an end view of the hinge shown in its closed (0°) position;

FIG. 8 illustrates the orientation of the hinged halves necessary to mate them together for deployment as a complete hinge;

FIG. 9 is an elevation view of the closed pin configuration of FIG. 7;

FIG. 10 is an end view of the closed pin configuration of FIG. 7 as seen from the right end;

FIG. 11 is a section taken along line 11—11 of FIG. 4;

FIG. 12 is a section taken along line 12—12 of FIG. 4;

FIG. 13 is a section taken along line 13—13 of FIG. 4;

SECOND EMBODIMENT: FIGS. 14 THROUGH 28, DRAWING SHEETS NO. 2 & 3

FIG. 14 is a front elevation view of a modification of the hinge wherein the sleeve and pin structure is helically defined to make the hinge inherently self-closing;

FIG. 15 is a side elevation view of the hinge of FIG. 14;

FIG. 16 is a section taken along line 16—16 of FIG. 14;

FIG. 17 is a top plan view of the modification of the hinge;

FIG. 18 is a rear elevation view of the modification;

FIG. 19 is a front elevation of the modified hinge swung rearwardly into the 0-degree position;

FIG. 20 is a rear elevation of the folded hinge;

FIG. 21 is a rear elevation view of the hinge halves separated;

FIG. 22 is a section taken along line 22—22 of FIG. 14;

FIG. 23 is a section taken along line 23—23 of FIG. 14;

FIG. 24 is a section similar to FIG. 22 but with the right hinge half shown in phantom;

FIG. 25 is section similar to FIG. 23 but with the left hinge half shown in phantom;

FIG. 26 is a top plan view of the hinge mounting a door swung into its zero-degree orientation;

FIG. 27 is a top plan view of the hinge mounting a door swung into its one-hundred-eighty-degree orientation; and, FIG. 28 is an elevation view of a left-handed hinge.

DETAILED DESCRIPTION OF THE PREFERRED EMBODIMENT

Figure 1:
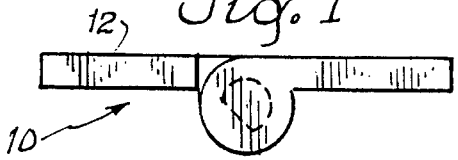
FIGS. 1 THROUGH 13, DRAWING SHEET NO. 1
Figure 2:
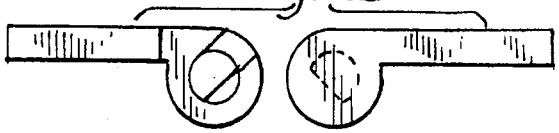

The first embodiment of the invention in the simplest form is shown on the first sheet of drawings in FIGS. 1 through 13. The hinge is comprised of a single piece indicated at 10, which is molded in a tough plastic such as polycarbonate to produce a rigid, resilient and durable part. Each part includes both the hinge pin sleeve and the hinge pin itself, which engage the corresponding structure of the other part so that the single part, used in pairs, defines a complete hinge unit.

Each part mounts to a respective one of the members to be hinged such as a door and frame, and defines whatever mounting interface configuration is appropriate, which in this disclosure is the mounting plate 12 with mounting screw holes 14. Any other convenient mounting configuration could be used or the hinge could be produced integrally with the structure to be hinged.

Each of the halves has a pin-mounting sleeve portion or boss 16 which is essentially identical in overall external configuration to the pin-engaging sleeves 18, which engage over the pin segments 20. When the two halves are coupled, the boss 16 and the sleeve define a smooth exterior which looks like a conventional hinge. Otherwise, it need not be the exact same configuration as the sleeves, as its function is to provide strong support for the pin segment 20 and prevent axial motion.

Figure 5:
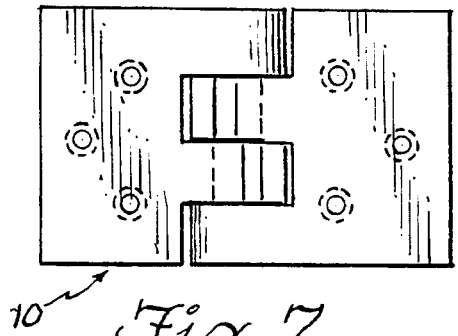

The pin segment 20 which extends from the pin-mounting boss extends across the open gap 22 as shown in FIG. 5, and terminates at the projected plane defined by the flat planar surface 24 of the sleeve 18. The pin segment is molded with a flat 26 on one side. This flat defines a dimension of reduced thickness indicated at 28 in FIG. 8, which permits the pin to slide through the entry slot 30, also shown in FIG. 8, but as soon as the two halves are mutually rotated from the coupling configuration they are locked and restricted to one-dimensional pivotal action as the effective thickness of the pin is now greater than the slot dimension. The hinge halves are now secured together as an integral unit and remain positively engaged provided they are not swung into the separable position shown in FIG. 8, which is about 270° degrees from the fully closed position shown in FIG. 7. It would be difficult or impossible to swing the hinge 270° in a properly installed door or gate installation, which would generally require only 90° swing clearance, or 180° at the most, as shown in the movement between FIGS. 26 and 27. Accidental dislodgement would therefore not ordinarily be a problem.

Figure 3:
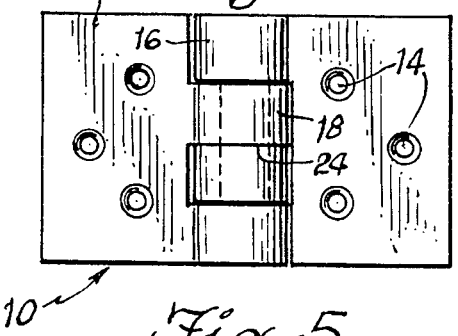
Figure 4:
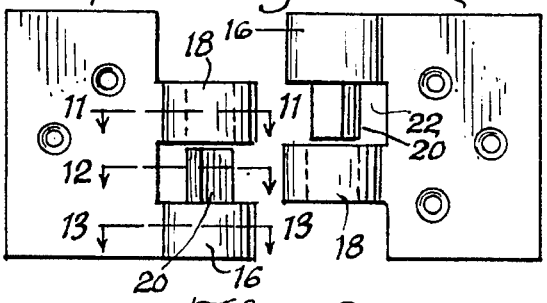
Figure 6:
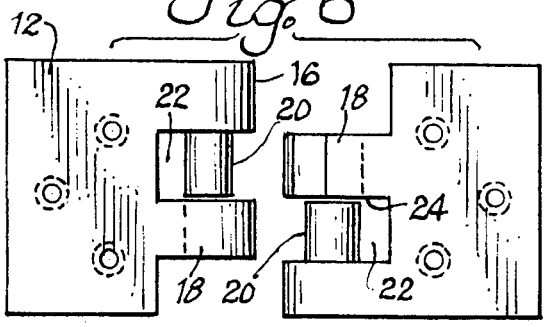
Figure 7:
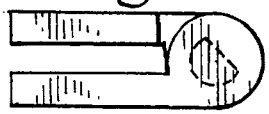
Figure 8:
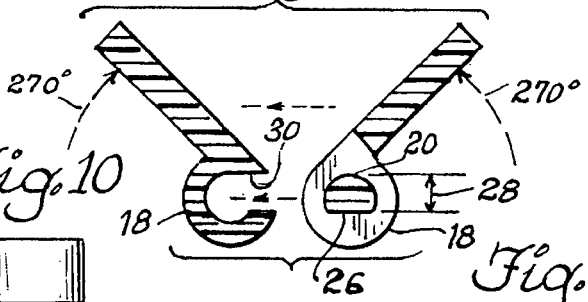
Figure 9:
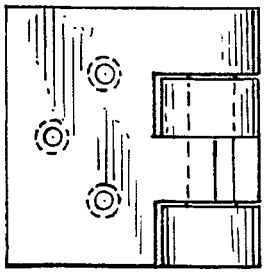
Figure 10:
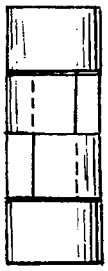
Figure 11:
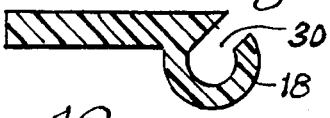
Figure 12:
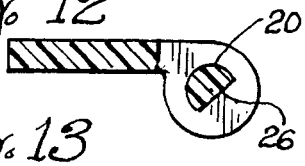
Figure 13:
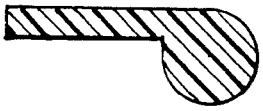
Figure 17:
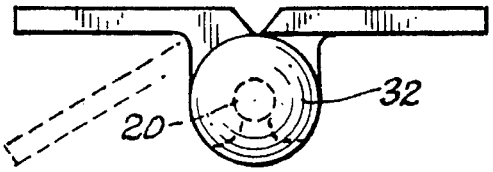

Since both halves are identical, when they are inverted relative to one another as shown in FIG. 6, oriented as shown in FIG. 8 and moved together, they engage as shown in FIGS. 3 and 5. Each pin segment projects from its pin mount into the sleeve of the other hinge half. No secondary structure such as a pin is required. This hinge is self-contained, tough, durable, light-weight and very inexpensive to make as it requires only a single mold cavity. Replacement and stocking cost are comparably reduced, and several sizes of the hinge should fit any outdoor purpose, with inside doors being similarly accommodated with the possible cosmetic re-configuration of the hinge externally to produce an aesthetic appearance integrated with the decor of the room.

Figure 15:
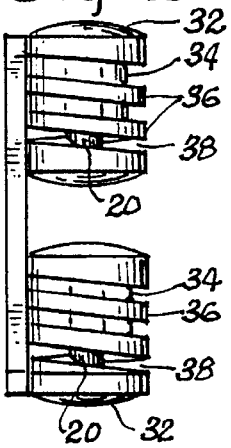
Figure 14:
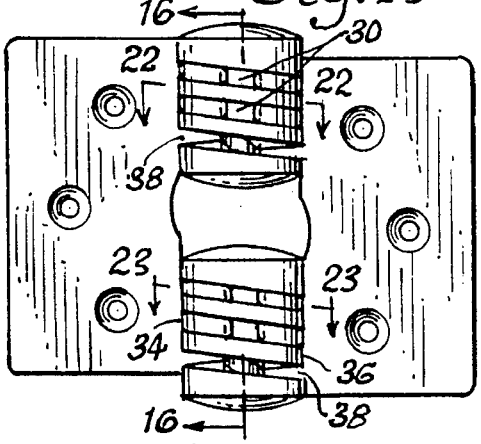
Figure 16:
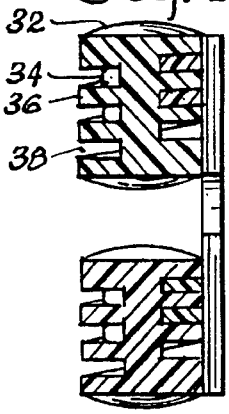
Figure 19:
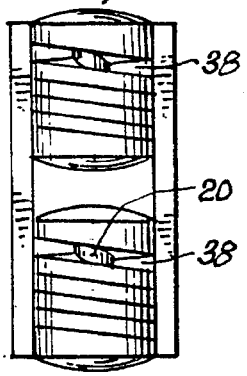

A second embodiment of the invention is illustrated in FIGS. 14 through 28 in the second sheet of drawings. This embodiment is conceptually substantially identical to the first, but is designed as a "self-closing" hinge. Self-closing is accomplished by the expedient of molding the sleeves in segments which do not define right circular cylinders as the sleeves of the first embodiment, but rather helically-cut cylinders as best shown in FIGS. 14–16 that ride up on one another in use. The simplest embodiment would be similar to FIGS. 1–13 but with an interface between the two halves that is helical.

However, partly with the goal of producing an interesting-looking hinge but also for increased vertical support strength at the hinge axis, the sleeves of the illustrated embodiment have been defined not as monolithic blocks as the first embodiment, but as multiple sleeve ribbons or segments 34 which act as spacers and are mutually spaced and parallel to accept in interstitial relation the complementing rib structure 36 extending from the pins of the other half. This configuration multiplies the horizontal component of the interface several times with an accompanying increase in support strength to the hinged member. In this instance pin endcaps 32 mount the hinge pin 20, which is molded integrally with the spaced helical ribs 36 which also support the pin as they are integral with the mounting plate 12.

The helical sleeve segments 34 are similar to the ribs 36 except that there is a void where the pin would otherwise be and the slot 30 admits the pin when properly oriented just as in the first embodiment. The effect is similar to the result that would be achieved by hellically cutting a hollow cylinder such that there are two side-by-side ribbons axially alternating along the length of the cylinder, one being attached to a first mount and the other to a second, with the mounts being pulled apart to slidably separate the two ribbons. The difference is, the sleeve segments 34 are internally void to accept the pin from the other half but the ribs 36 have the internal pin which engages the sleeve in the same way as in the first embodiment. Also, since the two halves cannot quite be pulled apart laterally like ribbons as described above, as that would require some axial separation of the two ribbons. Therefore the halves will have to be forced together and will thus require slight temporary deformation of the plastic.

Figure 20:
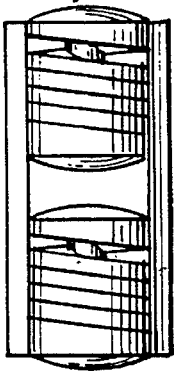
Figure 21:
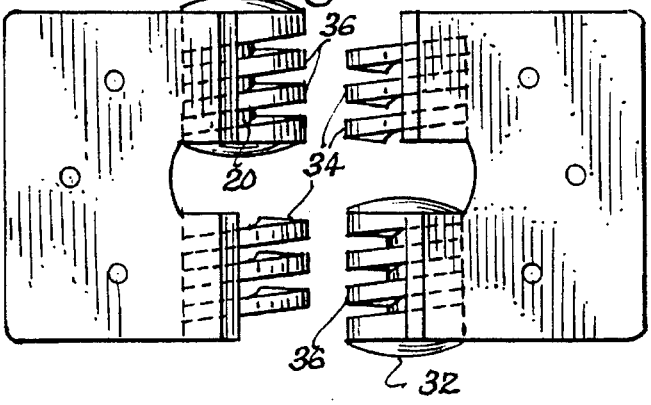

Once assembled, the helical segments axially alternate with ribs as shown in FIG. 20 and have the effect of causing each half to migrate axially with respect to the other half as the door or gate swings on the hinge. The gate or door will have a default preference for swinging in the direction that results in the swinging structure being the closest to the ground, and the hinge should be arranged if possible such that the two halves move into horizontal alignment when in the stable default (closed or open) position. Also, although each hinge is still made of two identical parts, left- and right-handed hinges will be needed for the second door of a swinging door pair. FIG. 28 illustrates a left-handed unit.

Figure 18:
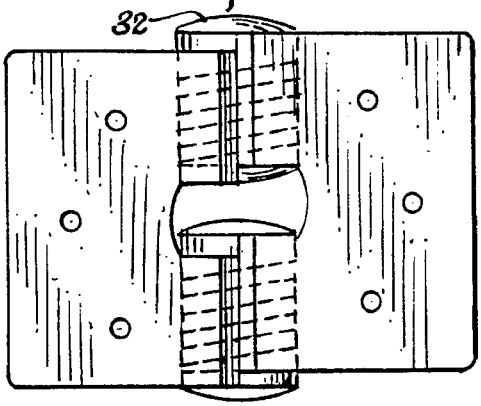

A gap 38 between the pin sand the sleeve segments of each half provides the clearance that the structure needs to accommodate the axial migration necessary to achieve the displacement illustrated in FIGS. 14 and 18. This gap migrates to one end or the other of the sleeve as the hinge is operated between its extreme positions.

The mold of the second embodiment is more expensive to make than in the first embodiment, but once made, innumerable pieces can be generated at a nominal per-unit cost. This hinge can be made according to a wide range of specifications regarding thickness, durability and strength. Any gate that should normally be closed or door that should be shut in its default mode, could be equipped with this hinge and although easily openable against the slight closing force of the hinge, would definitely have a preferred closed (or open) mode.

Lubricant can be impregnated into the hinge material, an advantage of elastomeric or polymeric materials over metal. The unit would last indefinitely, having a smooth operating motion. Provided the hinge is accurately mounted, the hinged member will smoothly swing into its default mode for a long time before friction finally, inevitably, interferes. The plastic materials from which the hinge could be made are available in an endless variety of colors and could also be made with an integral phosphor to assist in night navigation. It will not rust or produce sparks. Although a standard hinge configuration is shown, the hinge could be made long and thin like a piano wire hinge, with any number of sleeve segments and comparable pin segments. There is virtually no hinge specification which could not be met by a hinge of this design in one of the illustrated and exemplary modifications or in a logical extrapolation therefrom.

It is hereby claimed:

1. A hinge defining a pivotal axis and being comprised of first and second mating hinge halves, each of which halves defines:

(a) a pin substantially coaxial with said axis and having a reduced thickness in one transverse dimension;

(b) a slotted sleeve defining a bore coaxial with said pin and dimensioned to pass the pin of the other hinge half therethrough in substantially coaxial relation therewith;

(c) said slotted sleeve defining a longitudinal entry slot into said bore along the entire length thereof of width at least as great as said reduced thickness to permit the passing therethrough of said pin once said respective hinge half is oriented with the reduced thickness of said pin properly aligned with said slot; and (d) said sleeves and pins being oriented on their respective hinge halves such that when engaged, said pins span a substantial portion of the overall axial length of said hinge.

2. A hinge according to claim 1 wherein said hinge halves are substantially identical.

3. A hinge according to claim 2 wherein said hinge halves are molded plastic and produced from the same mold.

4. A hinge according to claim 1 wherein said sleeves are each defined as a plurality of sleeve segments spaced by gaps therebetween and said pin defines ribs extending radially outwardly therefrom and being shaped and dimensioned to accept the sleeved segments of the identically configured mating hinge half in close-fitting axially abutted flush relationship.

5. A hinge according to claim 4 wherein said sleeve segments and ribs snugly axially abut one another when said respective hinge halves are mated.

6. A hinge according to claim 5 wherein the sleeve segments and ribs of said hinge halves together axially span substantially the entire height of said hinge across the combined longitudinal dimension of said pins.

7. A hinge according to claim 6 wherein said sleeve segments and ribs are defined as continuous helical segments with helical spaces therebetween to accept the helical segments of a mating hinge half.

8. A hinge according to claim 7 wherein said ribs and pin are integrally molded to define a support for a hinged member and said ribs are at plural on each of said halves such that when said pivotal axis is vertical said ribs have a horizontal surface area component to support said sleeve segments which is multiplied compared to the horizontal surface area of a single rib to optimize support for said hinged member.

9. A hinge according to claim 1 wherein each of said halves defines a screw plate for mounting, and said halves are configured to swing together with said screw plates flush against one another in a zero-degree orientation, and swing outwardly from the zero-degree position to a position on the order of 270° removed from said zero-degree position such that said hinge can swing through an arc of substantially three-quarters of a full circle, and said hinge pins are aligned with said slots such that the reduced thicknesses thereof will pass through said slots at said position on the order of 270°.

10. A hinge according to claim 1 wherein said hinge pins are substantially cylindrical and said reduced dimension is defined by a flat on the side thereof.

11. A hinge according to claim 1 wherein said hinge halves are identical and molded from polycarbonate.

12. A hinge according to claim 1 wherein said hinge halves are impregnated with a delayed release lubricant.

13. A hinge according to claim 1 wherein said hinge halves are composed of a phosphorescent elastomeric material to delineate the hinged line of a hinged member in darkness.

* * * * *